US012458839B1

(12) United States Patent
Nolan et al.

(10) Patent No.: US 12,458,839 B1
(45) Date of Patent: Nov. 4, 2025

(54) DUAL DISC SYSTEM FOR EXERCISE MACHINES

(71) Applicant: Bulletproof Fitness Equipment Inc, Acton, CA (US)

(72) Inventors: Lawrence R Nolan, Santa Clarita, CA (US); Nicole K Nolan, Santa Clarita, CA (US); Christopher I Gaddy, Brooklyn, NY (US)

(73) Assignee: Bulletproof Fitness Equipment Inc, Acton, CA (US)

( * ) Notice: Subject to any disclaimer, the term of this patent is extended or adjusted under 35 U.S.C. 154(b) by 95 days.

(21) Appl. No.: 18/520,535

(22) Filed: Nov. 27, 2023

Related U.S. Application Data

(60) Provisional application No. 63/581,792, filed on Sep. 11, 2023, provisional application No. 63/428,327, filed on Nov. 28, 2022.

(51) Int. Cl.

| | |
|---|---|
| ***A63B 21/00*** | (2006.01) |
| ***A63B 21/062*** | (2006.01) |
| ***A63B 23/035*** | (2006.01) |
| ***A63B 23/12*** | (2006.01) |

(52) U.S. Cl.
CPC ..... *A63B 21/4047* (2015.10); *A63B 21/0628* (2015.10); *A63B 21/4035* (2015.10); *A63B 23/03533* (2013.01); *A63B 23/12* (2013.01)

(58) Field of Classification Search
CPC . A63B 21/0628; A63B 21/154; A63B 21/156; A63B 21/4035; A63B 21/4047; A63B 23/03533; A63B 23/03541; A63B 23/12; A63B 2225/09; A63B 2225/093
See application file for complete search history.

(56) References Cited

U.S. PATENT DOCUMENTS

| | | | | |
|---|---|---|---|---|
| 4,784,385 | A * | 11/1988 | D'Angelo | A63B 21/00069 482/111 |
| 8,500,607 | B2 * | 8/2013 | Vittone | A63B 21/0628 482/102 |
| 8,834,328 | B1 * | 9/2014 | Batca | A63B 23/03566 482/99 |
| 10,799,756 | B2 * | 10/2020 | Tuononen | A63B 21/0628 |
| 11,517,785 | B1 * | 12/2022 | Nolan | A63B 17/04 |

(Continued)

FOREIGN PATENT DOCUMENTS

EP 1066860 A2 * 1/2001 ..... A63B 21/16

*Primary Examiner* — Gary D Urbiel Goldner
(74) *Attorney, Agent, or Firm* — AVEK IP, LLC

(57) ABSTRACT

A dual disc system for use with an exercise machine includes a carriage to mount to a vertical post; a first bracket extending from the carriage; a second bracket pivotally engaged with the first bracket; a support connected to the second bracket and extending from a first side to a second side; a first wing pivotally engaged with the first side of the support; a second wing pivotally engaged with the second side of the support; first and second disc configurations supported by the first and second wings; the first disc configuration and the second disc configuration are configurable into at least three positions via the first bracket, the second bracket, the support, and the first wing and second wing; and one or more user engageable devices can engage with at least one of the first disc configuration and the second disc configuration for facilitating an exercise for a user.

18 Claims, 9 Drawing Sheets

(56) References Cited

U.S. PATENT DOCUMENTS

| | | | | |
|---|---|---|---|---|
| 11,602,662 | B2 * | 3/2023 | Horvath | A63B 21/169 |
| 11,801,416 | B2 * | 10/2023 | Horvath | A63B 21/4035 |
| 12,109,448 | B1 * | 10/2024 | Nolan | A63B 17/04 |
| 12,214,241 | B2 * | 2/2025 | Horvath | A63B 21/0626 |
| 12,303,739 | B1 * | 5/2025 | Nolan | A63B 21/0724 |
| 12,318,657 | B1 * | 6/2025 | Nolan | A63B 21/0626 |
| 2006/0160674 | A1 * | 7/2006 | Andrews | A63B 23/1245 482/92 |
| 2012/0035026 | A1 * | 2/2012 | Lyszczarz | A63B 21/4035 482/103 |
| 2012/0094813 | A1 * | 4/2012 | Berardo | A63B 21/4035 482/139 |

* cited by examiner

DUAL DISC SYSTEM FOR EXERCISE MACHINES

RELATED APPLICATIONS

This application claims the benefit of U.S. provisional application 63/581,792 filed Sep. 11, 2023, and also claims the benefit of U.S. provisional application 63/428,327, filed Nov. 28, 2022, both of the foregoing are incorporated by reference in their entireties herein.

FIELD OF INVENTION

The disclosure relates generally to exercise equipment. More specifically, the disclosure relates to a dual disc system for use with an exercise machine, the dual disc system having a pair of disc configurations that are designed to operate in at least three positions and include multiple receivers for attaching user engageable devices such that a user can select a desired exercise based on positioning and selection of user engageable devices.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure, the invention includes a dual disc system for use with an exercise machine, the dual disc system comprising a carriage configured to mount to a vertical post as part of the exercise machine; a first bracket extending from the carriage; a second bracket engaged with the first bracket via a first pivot connection such that the second bracket can pivot relative to the first bracket; a support connected to the second bracket and extending from a first side to a second side; a first wing pivotally engaged with the first side of the support; a second wing pivotally engaged with the second side of the support; a first disc configuration supported by the first wing and configured to engage with a first cable; and a second disc configuration supported by the second wing and configured to engage with a second cable. The first disc configuration and the second disc configuration are configurable into at least three positions via the first bracket, the second bracket, the support, and the first wing and second wing. One or more user engageable devices are configured to engage with at least one of the first disc configuration and the second disc configuration for facilitating an exercise for a user.

According to another embodiment of the current disclosure, the present invention relates to an exercise machine, comprising a support structure configured to rest on a ground surface, the support structure having a vertical post extending upward from the ground surface, and a dual disc system to mount to the vertical post. The dual disc system includes a carriage configured to mount to the vertical post; a first bracket extending from the carriage; a second bracket engaged with the first bracket via a first pivot connection such that the second bracket can pivot relative to the first bracket; a support connected to the second bracket and extending from a first side to a second side; a first wing pivotally engaged with the first side of the support; a second wing pivotally engaged with the second side of the support; a first disc configuration supported by the first wing and configured to engage with a first cable; and a second disc configuration supported by the second wing and configured to engage with a second cable. The first disc configuration and the second disc configuration are configurable into at least three positions via the first bracket, the second bracket, the support, and the first wing and the second wing. A pair of user engageable devices are each independently engaged with one of the first disc configuration and the second disc configuration, the pair of user engageable devices configured to be operated by a user to perform an exercise.

BRIEF DESCRIPTION OF THE DRAWINGS

Embodiments of the invention are described in detail below with reference to the attached drawings.

The drawings do not limit the invention to the specific embodiments disclosed and described herein. The drawings are not necessarily to scale, emphasis instead being placed upon clearly illustrating various principles of the disclosure.

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Exercise equipment is well known in the art and varies from complex machinery to simple devices, wherein a user may select various equipment based on exercises they desire to perform. It is beneficial for exercise equipment to provide a user with a variety of configurations, particularly with a small footprint for the equipment. This allows for a user to diversify their workout without the need for numerous machines or a large space. Such diversified equipment is therefore more cost effective and convenient. Such diversification of equipment is beneficial for both gyms, as well as for home use.

The present invention provides for a dual disc system that is configured for use with an exercise machine, the dual disc system including a support system and two disc configurations, wherein the support system allows for the two disc configurations to orient in at least three positions. The present invention also includes a plurality of receivers, such that a variety of user engageable devices may be engaged with the disc configurations. The combination of these two features provides for a convenient system that can be used for a number of exercises, while taking up a small footprint, such as in a gym or home. For example, a user can select a first pair of user engageable devices, orient the disc configurations into one of the three positions, and then perform one exercise. With minimal effort, the user can then reorient the disc configurations into a second of the three positions and perform a second exercise. The dual disc system remaining attached to the same machine, and therefore taking up minimal space.

Figure 1:
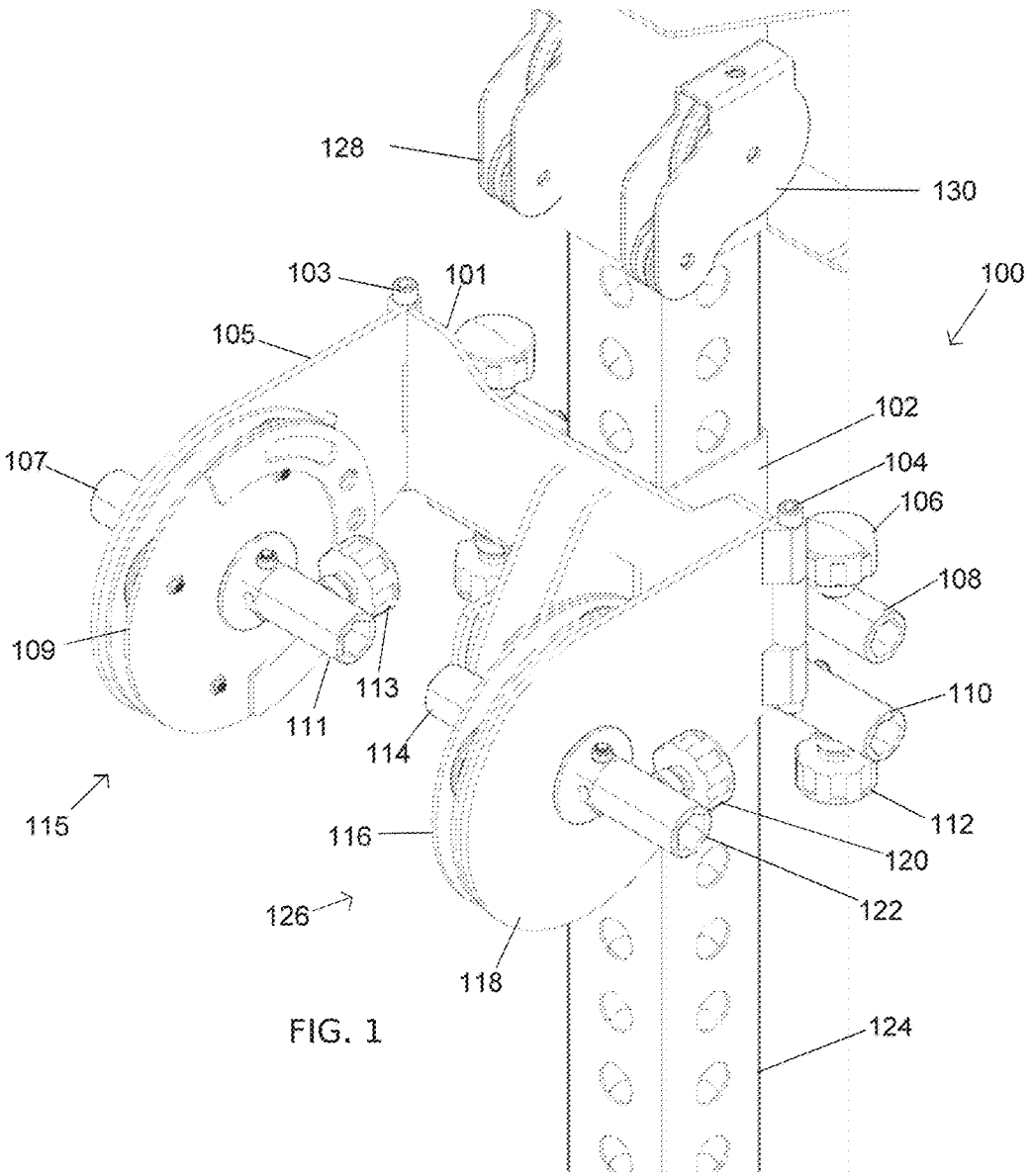
FIG. 1 is an angled view of a dual disc system in a first position for use with an exercise machine in accordance with the present disclosure.
Figure 2:
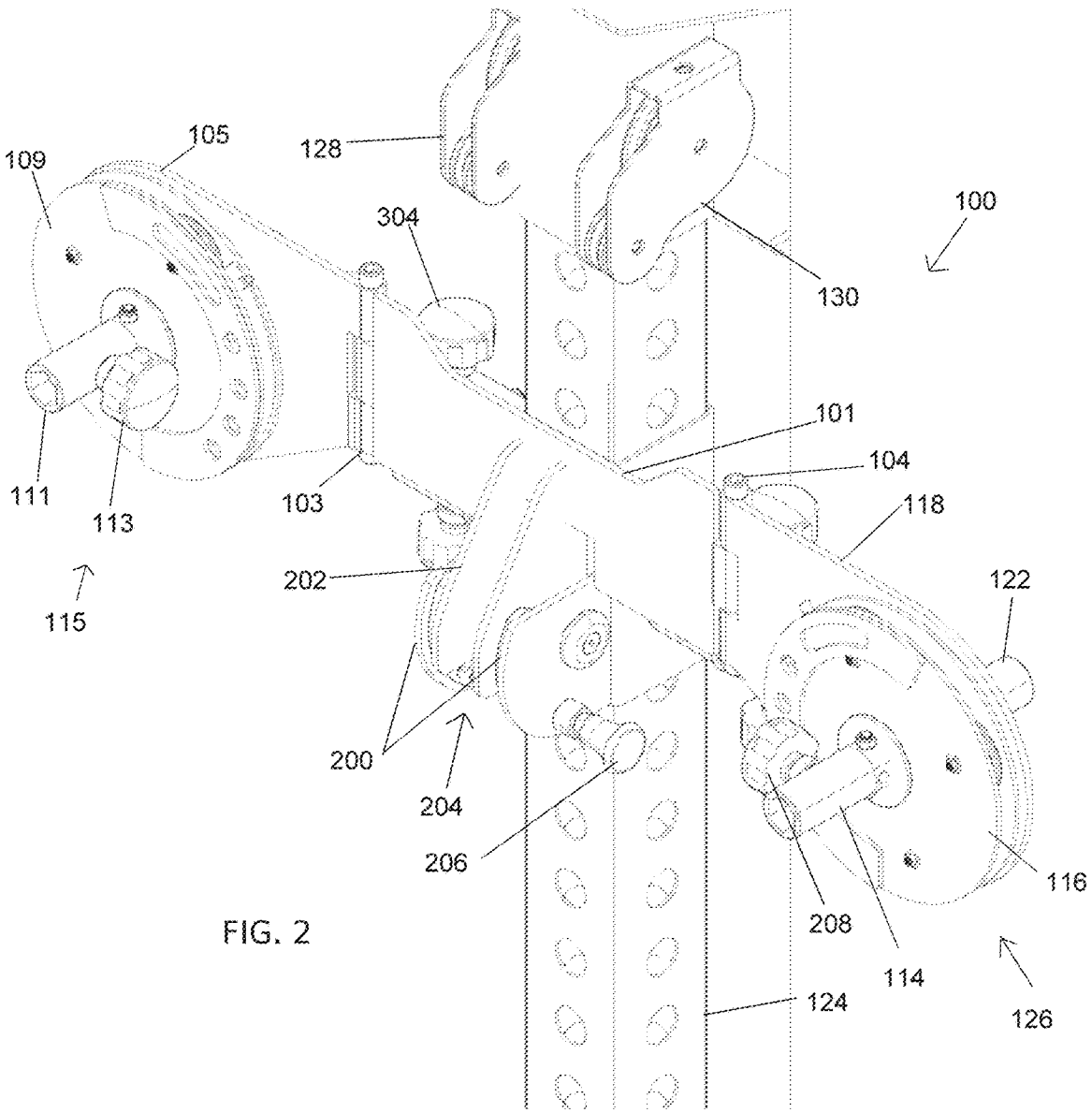
FIG. 2 is an angled view of the dual disc system of FIG. 1 in a second position.
Figure 3:
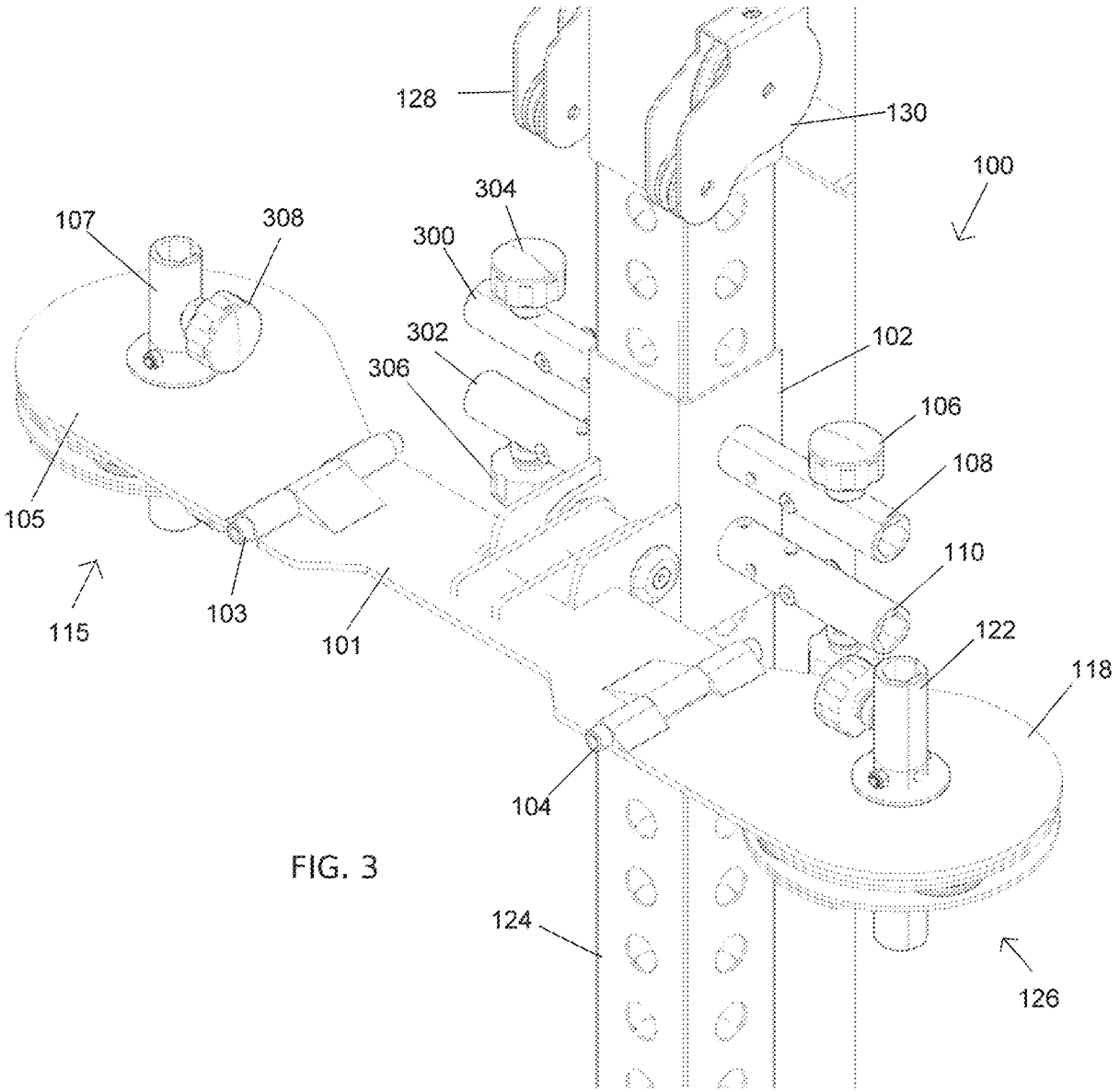
FIG. 3 is an angled view of the dual disc system of FIG. 1 in a third position.

FIGS. 1-3 depict the dual disc system 100 in first, second, and third positions respectively. The dual disc system 100 includes a carriage 102 that is configured to secure to a vertical post 124 or other vertical support structure. The vertical post 124 may be part of an overall exercise machine, or may be an independent vertical post. The carriage 102 may vary, be added retroactively to the vertical post 124, or incorporated directly into the vertical post 124, and can be selectively positioned along the vertical post 124 to suit a user's height or suit the exercise being performed. Those skilled in the art will appreciate that the securement of the carriage may be achieved via pins or other locking devices.

The carriage 102 supports a first bracket 200 extending in a forward direction and pivotally connected to a second bracket 202 via a pivot connection 204. As shown, the first bracket 200 extends directly forward such that the second bracket 202 is positioned between the two extending portions of the first bracket 200. The first bracket 200 may be integral with the carriage 102 and therefore manufactured as a single unit. The pivot connection 204 may vary but regardless allows for the second bracket 202 to pivot between at least a first position (FIGS. 1 and 2) and a second position (FIG. 3). A locking pin 206 locks the second bracket 202 in the desired position relative to the first bracket 200. In other words, the locking pin 206 is configured to retract to allow for pivoting, and then extend through both of the first bracket 200 and the second bracket 202 to lock.

A support 101 is attached to the second bracket 202 and extends from a first side to a second side, wherein a first wing 105 and a second wing 118 are pivotally engaged with the first and second sides of the support 101 respectively as shown. The support 101 and second bracket 202 can be a single, integral piece as shown. In embodiments, the support 101 creates a T-shape relative to the second bracket 202 such that the wings 105, 118 are positioned outside of the carriage 102 on opposite sides of the vertical post 124. Pivot connections 103, 104 allow for the wings 105, 118 to pivot between a first position (FIG. 1) and a second position (FIG. 2). As shown, the first position directs the wings 105, 118 directly forward from the vertical post 124, whereas the second position directs the wings 105, 118 outward from the vertical post 124. The pivot connections 103, 104 may be hinges or other types of connections that allow for pivoting as would be understood by those skilled in the art. Accordingly, the configuration discussed above allows for the dual disc system 100 to maneuver between at least three positions, as shown in FIGS. 1, 2, and 3. The flexibility in positions provides for increased diversity of use of the dual disc system 100.

As best shown in FIG. 3, the carriage 102, in embodiments, includes a plurality of receivers 108, 110, 300, 302, wherein each receiver includes a locking pin 106, 112, 304, 306. Although two pairs, one pair per side, are shown, it is contemplated that additional or fewer receivers may be added without departing from the present invention. The receivers 108, 110, 300, 302 allow additional exercise functionality by serving as attachment points for accessories such as seat pads or thigh pads, such that the system may be used for various other exercises, such as seated leg focused isolation exercises or front-facing leg exercises, such as leg curls or leg extensions. In other words, the user may adjust positioning of the carriage 102 along the vertical post 124, and add one or more accessories to one or more of the receivers in order to facilitate a desired exercise. In some embodiments, the receivers 108, 110, 300, 302 include hexagonal cross sections, which creates a secure lock against the accessories attached thereto.

Each wing 105, 118 supports a disc configuration 115, 126, each disc configuration 115, 126 including a cable support 109, 116. The cable supports 109, 116 engage with cables (not shown) that extend to cable guides 128, 130 positioned on and attached to the vertical post 124. Each cable guide 128, 130 can vary as would be understood by those skilled in the art, such as including one or more wheels to guide a cable moving therethrough, wherein the cable may extend to one or more weights or other resistance (as shown in FIGS. 4-9). Similarly, the cable supports 109, 116 include one or more wheels or other similar guides, to provide for engagement with a cable as would be understood by those skilled in the art. Accordingly, the cable supports 109, 116 will operate to provide resistance to a user through the cable(s), weights, and the like.

Each disc system 115, 126 further supports a receiver 111, 114 for receiving and securing to a user engageable device, the receiver 111, 114 coupled to the cable support 109, 116 such that the user engageable device coupled thereto is utilized to operate a cable. In other words, a user engageable device can attach to receiver 111, which is coupled to cable support 109, such that operation of the user engageable device will rotate the cable support 109 to engage with and create resistance via an associated cable. The user engageable device may vary, including various arms, handles, bars, pads, etc., wherein the user engageable device allows for operation of the disc system 115, 126 when engaged by a user. Each receiver 111, 114 further includes a locking pin 116, 208 such that a user engageable device is locked in place during use. Again, the receivers 111, 114 may be hexagonal in cross section to create a secure lock against the user engageable device.

The dual disc system 100 further includes exterior receivers 122, 107, again with associated locking pins 120, 308 for receiving and engaging with additional user engageable devices. These receivers 122, 107 extend from the wings 105, 118 opposite of receivers 111, 114. The combination and arrangement of the plurality of receivers throughout the dual disc system 100 allows for a user to fully customize how and where they attach user engageable devices. This again provides for a system that has numerous configurations, while taking up a small floor footprint. Accordingly, the user can customize their workout with fewer machines.

Figure 4:
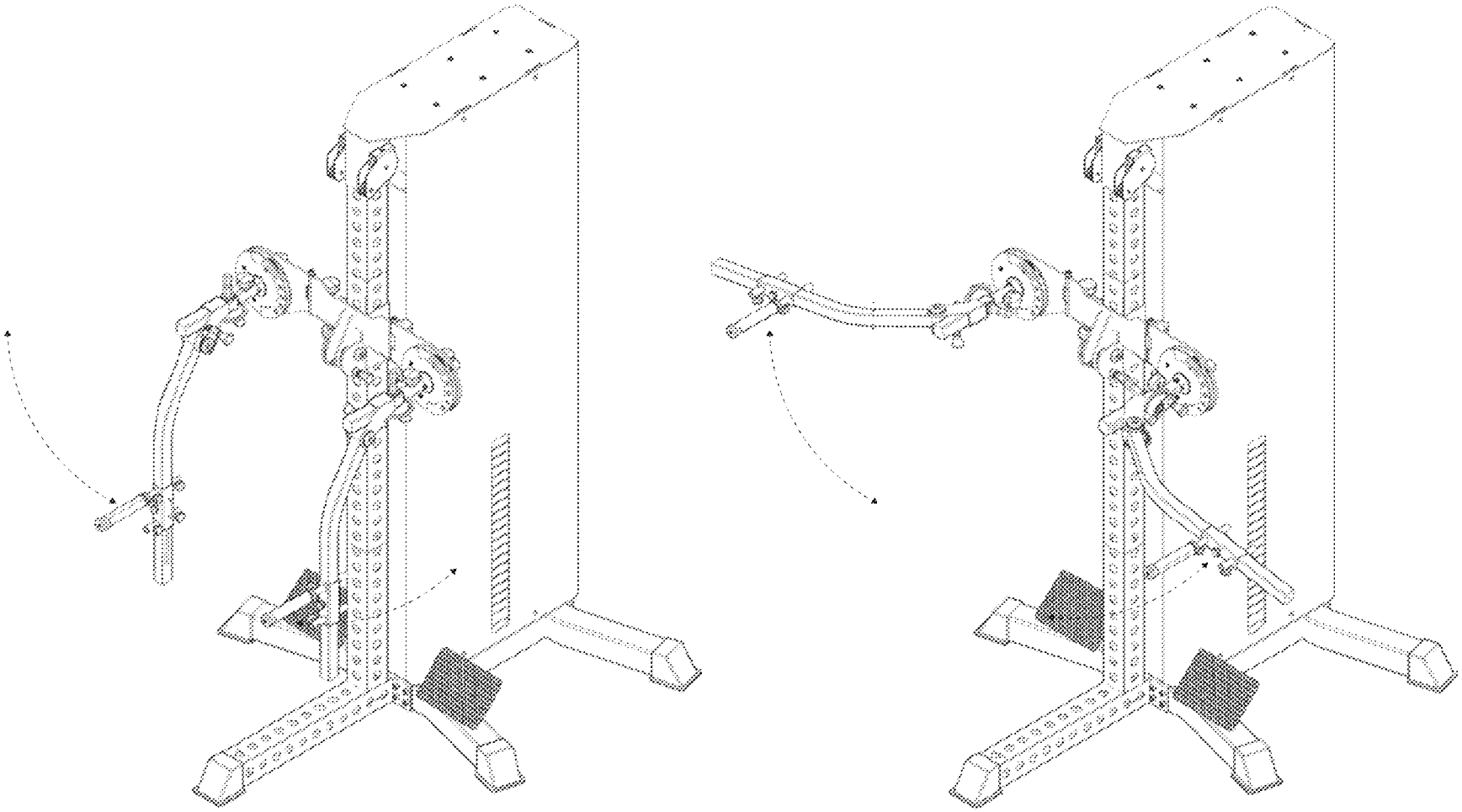
FIG. 4 is an angled view showing operation of a first set of user engageable devices with the dual disc system of FIG. 1.
Figure 5:
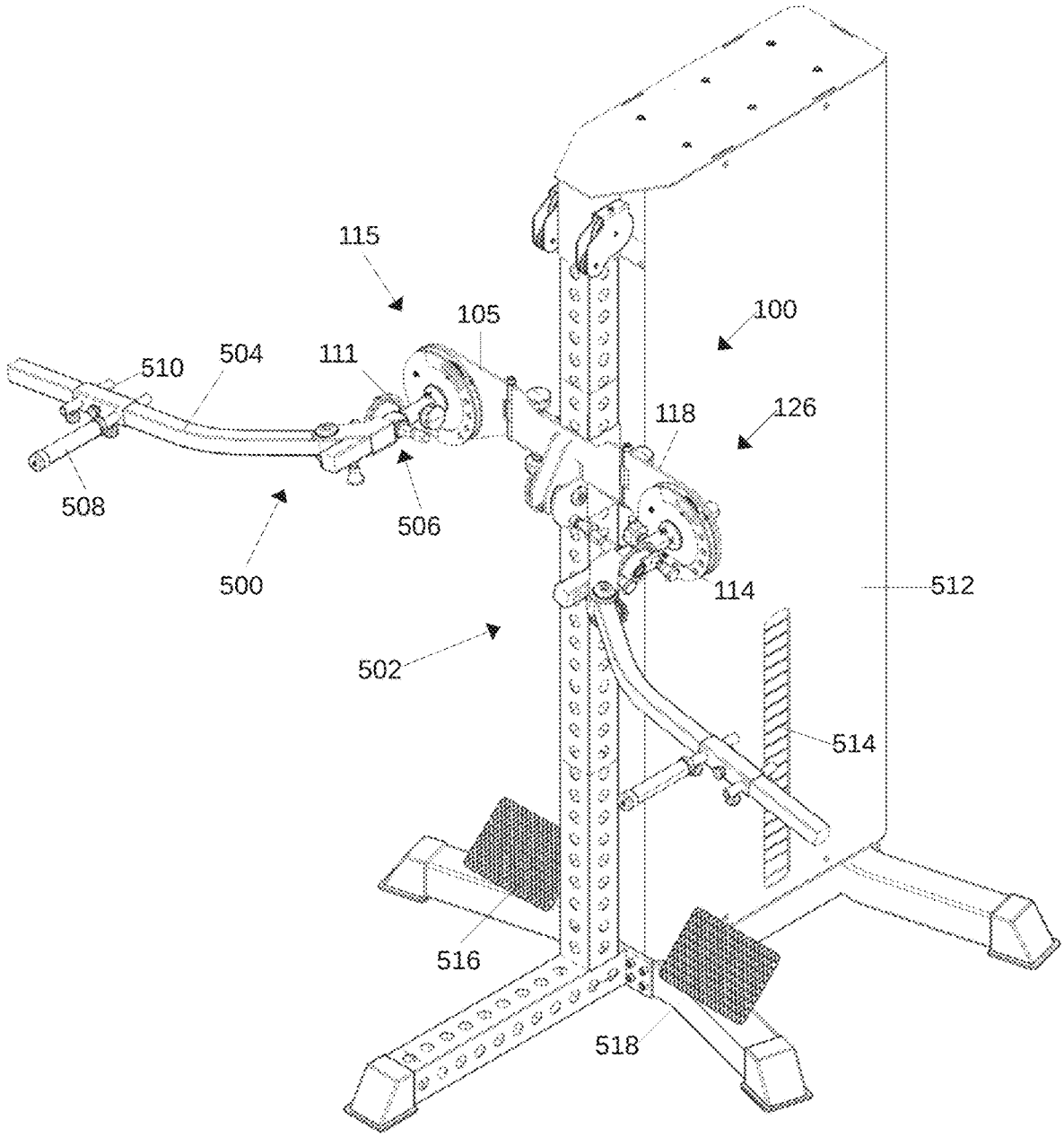
FIG. 5 is an angled view showing the first set of user engageable devices of FIG. 4.
Figure 6:
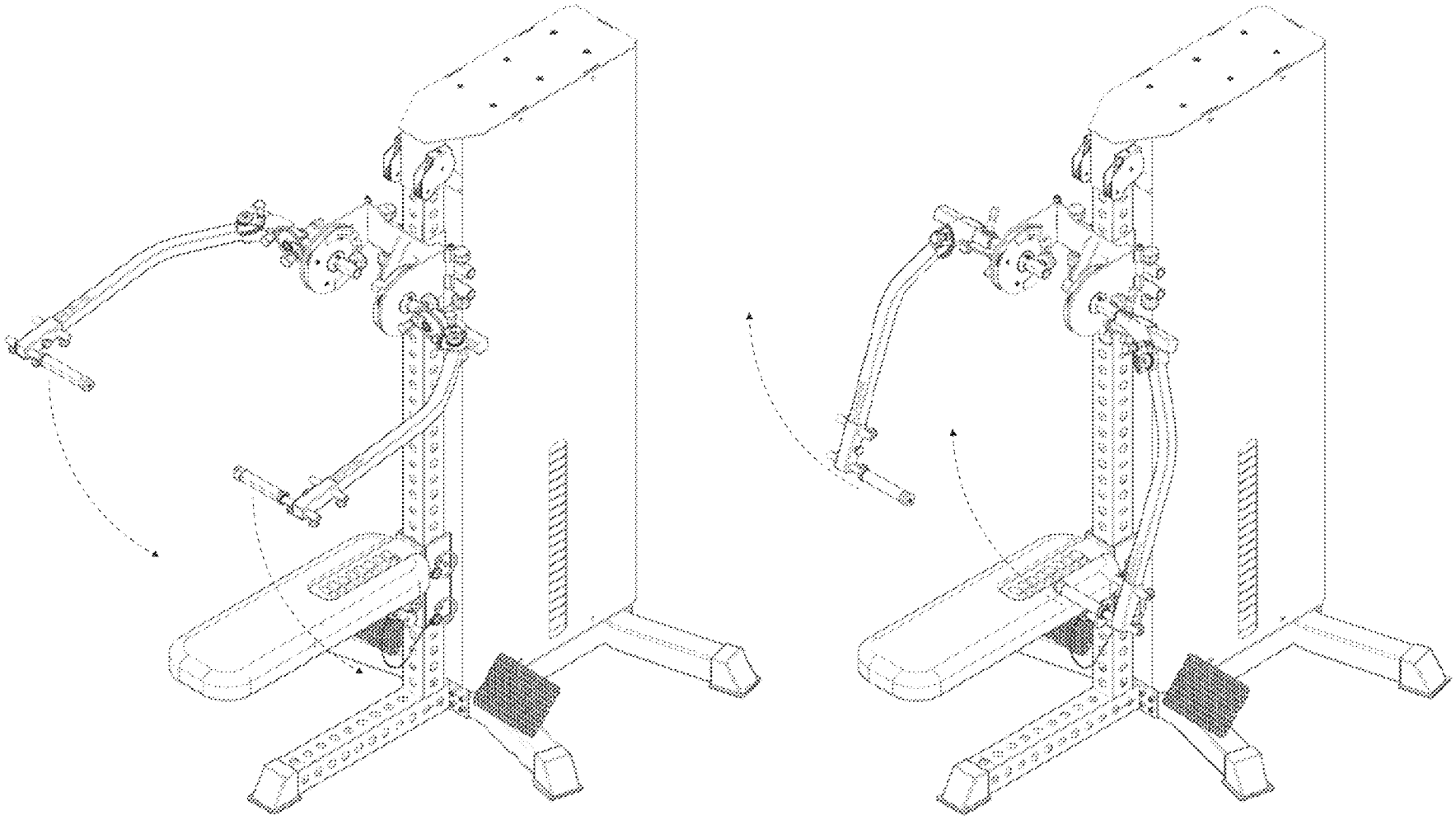
FIG. 6 is an angled view showing operation of a second set of user engageable devices with the dual disc system of FIG. 1.
Figure 7:
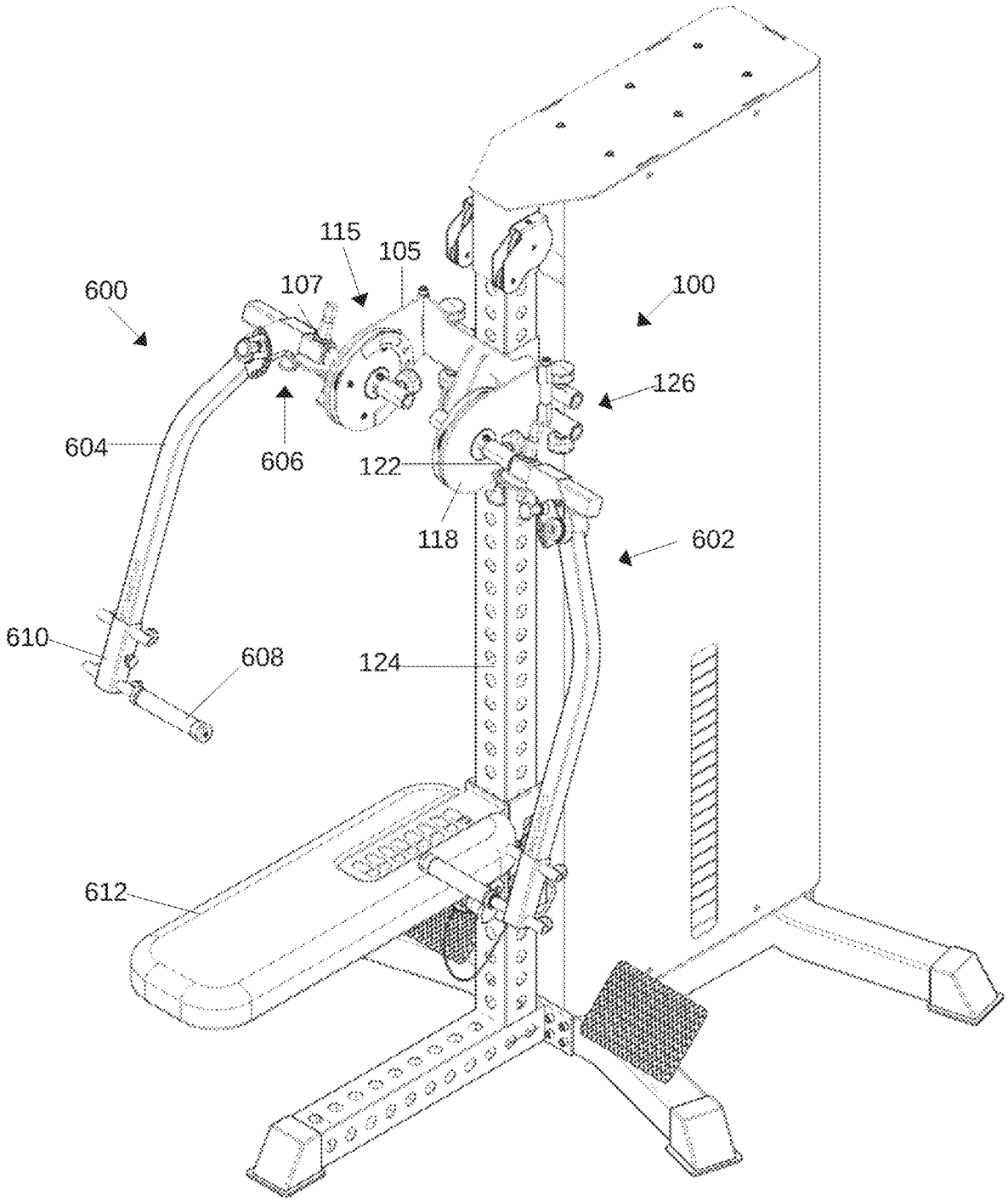
FIG. 7 is an angled view showing the second set of user engageable devise of FIG. 6.
Figure 8:
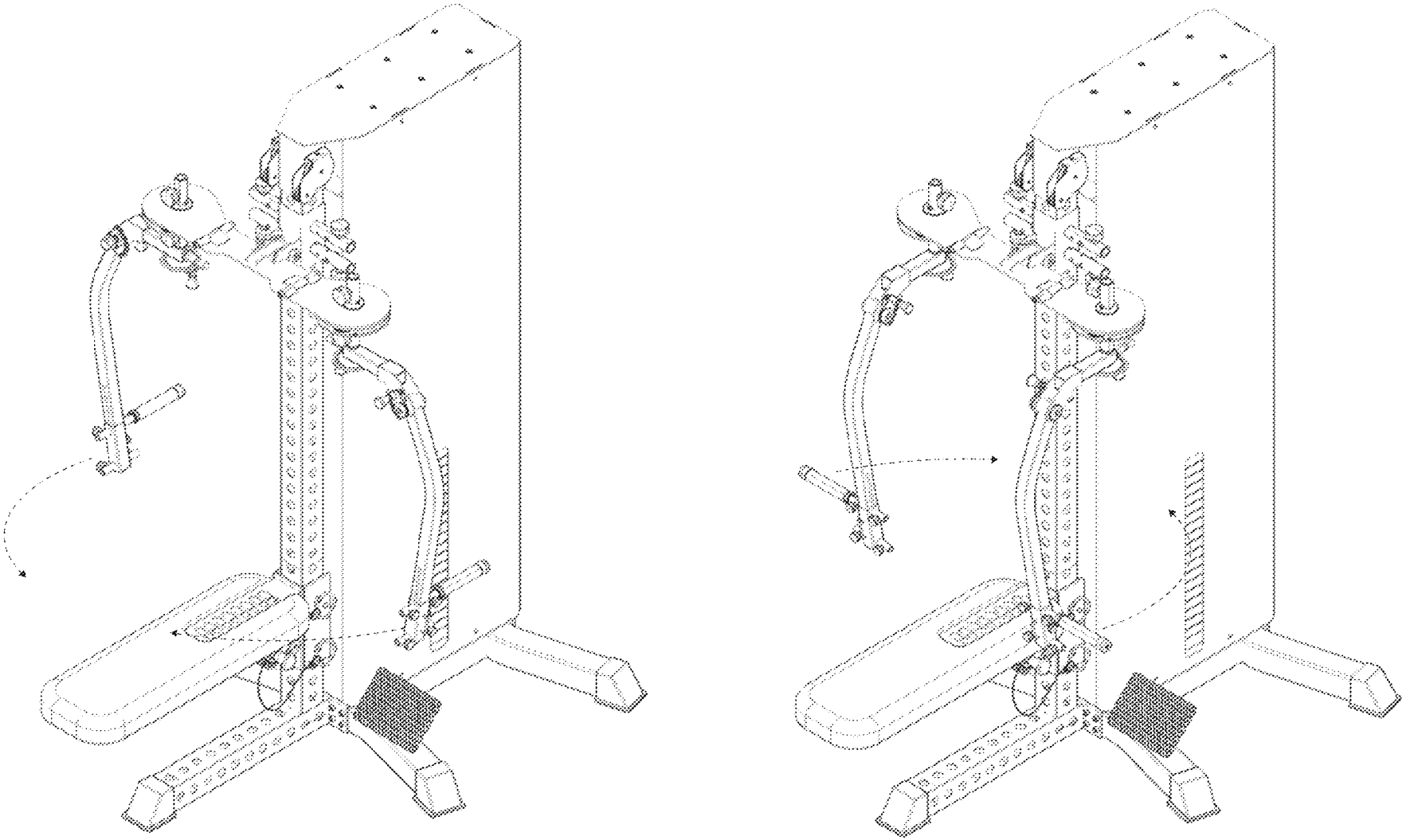
FIG. 8 is an angled view showing operation of a third set of user engageable devices with the dual disc system of FIG. 1.
Figure 9:
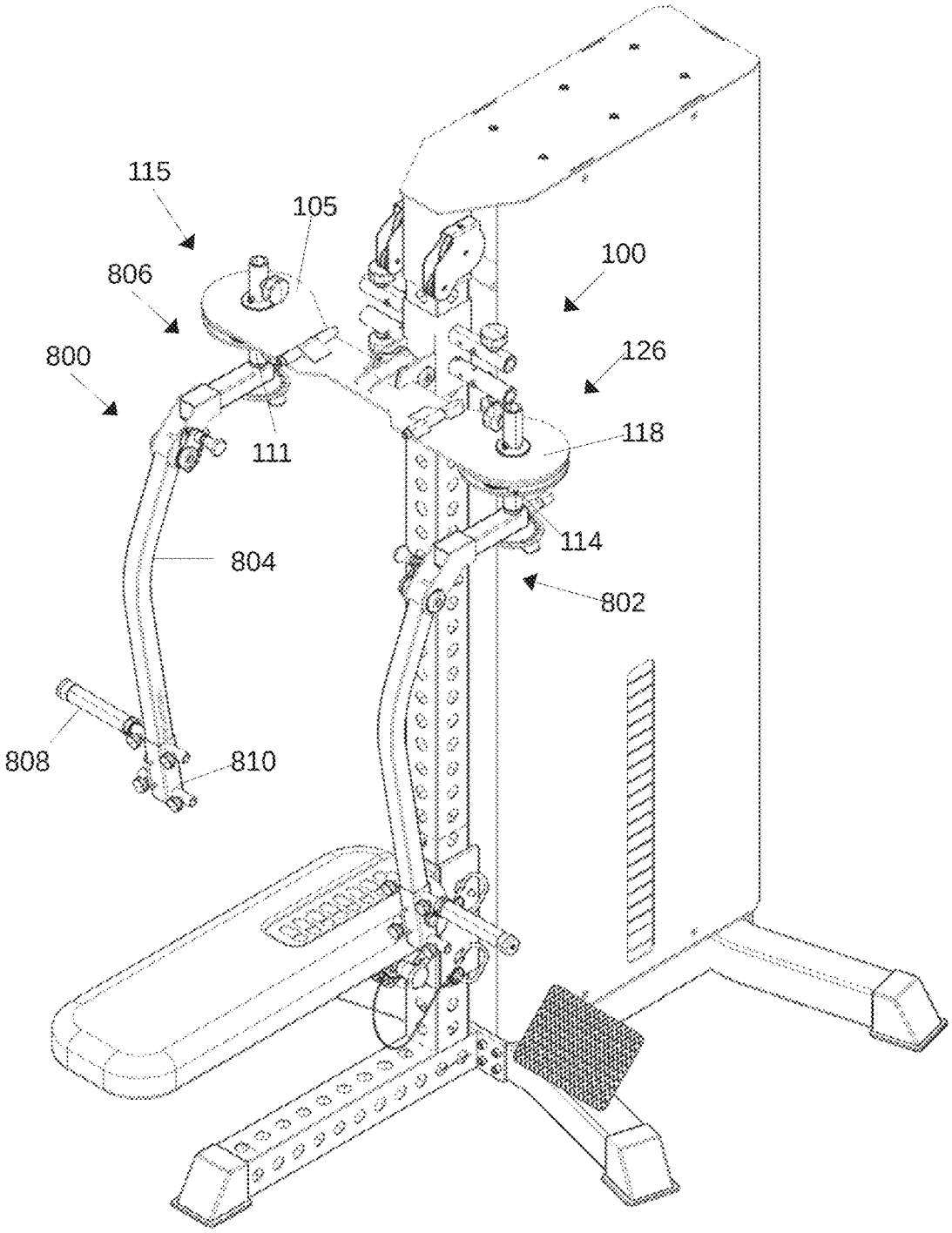
FIG. 9 is an angled view showing the third set of user engageable devices of FIG. 8.

The dual disc system 100 allows for a user to engage a variety of user engageable devices. For example, FIGS. 4, 6, and 8 depict pairs of user engageable devices, with operational arrows to depict examples of use. FIGS. 5, 7, and 9 further show the configurations for clarity of the user engageable devices.

In FIGS. 4 and 5, the first pair of user engageable devices 500, 502 are shown. Here, the two user engageable devices are independently attached to receivers 111, 114 and accordingly are configured to rotate relative to the wings 105, 118 in an upward motion as shown in FIG. 4. The user engageable devices 500, 502 can each have an arm 504 coupled to an attachment system 506, wherein the attachment system 506 includes one or more means of adjustability as shown, and wherein the attachment system 506 is configured to engage with the associated receiver 111. A handle 508 with a handle carriage 510 is coupled to the arm 504 such that a user can operate the device 500. In FIGS. 4-9, the dual disc system 100 is further demonstrated as part of an overall machine, having a support structure, example structure 512 housing a plurality of weights 514, wherein a cable (not shown) may extend to the weights 514 to created weighted resistance. In embodiments, foot plates 516, 518 are also provided for use by the user. Those skilled in the art will appreciate that the style and features of the machine may vary and are not limited by the present examples.

In FIGS. 6 and 7, another pair of user engageable devices 600, 602 are shown. These devices 600, 602 are similar to devices 500, 502 but with different adjustments and attachment points. Here, the user engageable devices are independently attached to exterior receivers 107, 122 on the outside of the wings 105, 118. The user engageable devices 600, 602 can vary, but in embodiments include an arm 604 coupled to an attachment system 606 which is further coupled to the associated receiver 107. The attachment system 606 can include various means of adjustability to again allow for the user to fully customize their equipment. One or more handles 608 are engaged with the arm 604 via an adjustable handle carriage 610. As discussed above, the machine itself may vary, however in some embodiments a bench 612 is attached to the vertical post 124 such that the user may sit or lie down on the bench 612. The bench 612 is adjustable in height and other configurations such that the user is supported as needed or desired for various exercises.

In FIGS. 8 and 9, another pair of user engageable devices 800, 802 are shown, with the dual disc system 100 in a different configuration. Specifically, the user engageable devices 800, 802 are attached to receivers 111, 114 wherein the receivers 111, 114 are oriented to face downward and toward the ground surface. As shown, this configuration then extends the devices 800, 802 downward for engagement and use by the user. Again, a bench may be added for supporting the user during operation of the devices 800, 802. Again, each of the user engageable devices can include an arm 804 coupled to an attachment system 806 with various means of adjustability. The arm 804 also supporting one or more handles 808 on a handle carriage 810.

Those skilled in the art will appreciate that the configurations shown in FIGS. 4-9 are exemplary and any style of user engageable device could be supported by the dual disc system 100.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. A dual disc system for use with an exercise machine, the dual disc system comprising:

a carriage configured to mount to a vertical post as part of the exercise machine;

a first bracket extending from the carriage;

a second bracket engaged with the first bracket via a first pivot connection such that the second bracket can pivot relative to the first bracket;

a support connected to the second bracket and extending from a first side to a second side;

a first wing pivotally engaged with the first side of the support;

a second wing pivotally engaged with the second side of the support;

a first disc configuration supported by the first wing and configured to engage with a first cable; and a second disc configuration supported by the second wing and configured to engage with a second cable;

wherein the first disc configuration and the second disc configuration are configurable into at least three positions via the first bracket, the second bracket, the support, and the first wing and the second wing; and wherein one or more user engageable devices are configured to engage with at least one of the first disc configuration and the second disc configuration for facilitating an exercise for a user.

2. The system of claim 1, further comprising:

a first exterior receiver extending from the first disc configuration;

a second exterior receiver extending from the second disc configuration;

a first interior receiver extending from the first disc configuration in a direction opposite of the first exterior receiver; and a second interior receiver extending from the second disc configuration in a direction opposite the second exterior receiver;

wherein the first exterior receiver, the second exterior receiver, the first interior receiver, and the second interior receiver are configured to receive the one or more user engageable devices.

3. The system of claim 1, wherein the at least three positions comprise:

a first position defined by the second bracket being pivoted upwards such that the support is adjacent to the vertical post and the first wing and the second wing are pivoted inwards such that both the first wing and the second wing extend in a forward direction away from the vertical post.

4. The system of claim 3, wherein the at least three positions further comprises:

a second position defined by the second bracket being pivoted upwards such that the support is adjacent to the vertical post and the first wing and the second wing are pivoted outwards such that the first wing is extended to a right side of the vertical post and the second wing is extended to a left side of the vertical post.

5. The system of claim 4, wherein the at least three positions further comprises:

a third position defined by the second bracket being pivoted downwards such that the support is not positioned adjacent to the vertical post and the first wing and the second wing are pivoted outwards such that the first wing is extended to the right side of the vertical post and the second wing is extended to the left side of the vertical post.

6. The system of claim 1, further comprising one or more carriage receivers extending from the carriage.

7. The system of claim 6, wherein the one or more carriage receivers each comprise a hexagonal cross section.

8. The system of claim 6, wherein the one or more carriage receivers comprises a first pair of receivers extending from a first side of the carriage and a second pair of receivers extending from a second side of the carriage.

9. The system of claim 1, further comprising one or more cable guides attached to the vertical post and configured to support the first and second cables respectively extending from the first disc configuration and the second disc configuration.

10. An exercise machine, comprising:

a support structure configured to rest on a ground surface, the support structure having a vertical post extending upward from the ground surface;

a dual disc system having a carriage configured to mount to the vertical post, the dual disc system having:

a first bracket extending from the carriage;

a second bracket engaged with the first bracket via a first pivot connection such that the second bracket can pivot relative to the first bracket;

a support connected to the second bracket and extending from a first side to a second side;

a first wing pivotally engaged with the first side of the support;

a second wing pivotally engaged with the second side of the support;

a first disc configuration supported by the first wing and configured to engage with a first cable; and a second disc configuration supported by the second wing and configured to engage with a second cable;

wherein the first disc configuration and the second disc configuration are configurable into at least three positions via the first bracket, the second bracket, the support, and the first wing and the second wing;

a pair of user engageable devices each independently engaged with one of the first disc configuration and the second disc configuration, respectively, the pair of user engageable devices configured to be operated by a user to perform an exercise.

11. The exercise machine of claim 10, wherein the dual disc system further comprises:

a first exterior receiver extending from the first disc configuration;

a second exterior receiver extending from the second disc configuration;

a first interior receiver extending from the first disc configuration in a direction opposite of the first exterior receiver; and a second interior receiver extending from the second disc configuration in a direction opposite the second exterior receiver;

wherein the first exterior receiver, the second exterior receiver, the first interior receiver, and the second interior receiver are configured to respectively receive the pair of user engageable devices.

12. The exercise machine of claim 10, wherein the at least three positions comprise:

a first position defined by the second bracket being pivoted upwards such that the support is adjacent to the vertical post and the first wing and the second wing are pivoted inwards such that both the first wing and the second wing extend in a forward direction away from the vertical post.

13. The exercise machine of claim 12, wherein the at least three positions further comprises:

a second position defined by the second bracket being pivoted upwards such that the support is adjacent to the vertical post and the first wing and the second wing are pivoted outwards such that the first wing is extended to a right side of the vertical post and the second wing is extended to a left side of the vertical post.

14. The exercise machine of claim 13, wherein the at least three positions further comprises:

a third position defined by the second bracket being pivoted downwards such that the support is not positioned adjacent to the vertical post and the first wing and the second wing are pivoted outwards such that the first wing is extended to the right side of the vertical post and the second wing is extended to the left side of the vertical post.

15. The exercise machine of claim 10, wherein the dual disc system further comprises one or more carriage receivers extending from the carriage.

16. The exercise machine of claim 15, wherein the one or more carriage receivers each comprise a hexagonal cross section.

17. The exercise machine of claim 10, wherein the pair of user engageable devices comprises a first user engageable device having an attachment system coupled to a receiver of the first disc configuration, an arm coupled to the attachment system and extending away from the attachment system, and a handle engaged with the arm, wherein the handle is configured to be operated by the user to perform the exercise.

18. The exercise machine of claim 10, further comprising a bench attached to the vertical post at a position below the dual disc system.

* * * * *